US005195683A

United States Patent [19]

Gaetano

[11] Patent Number: 5,195,683

[45] Date of Patent: * Mar. 23, 1993

[54] COMBINATION PHOTOGRAPHIC NEGATIVE AND PROOF HOLDER

[75] Inventor: Ralph R. Gaetano, Bethel Park, Pa.

[73] Assignee: Think, Inc., Pittsburgh, Pa.

[ * ] Notice: The portion of the term of this patent subsequent to Jan. 21, 2009 has been disclaimed.

[21] Appl. No.: 748,232

[22] Filed: Aug. 23, 1991

Related U.S. Application Data

[63] Continuation-in-part of Ser. No. 578,737, Sep. 6, 1990, Pat. No. 5,082,168.

[51] Int. Cl.[5] ..... B65D 27/08

[52] U.S. Cl. ..... 229/72; 229/1.5 R; 206/455; 206/491; 493/243; 493/920

[58] Field of Search ..... 229/1.5 R, 72; 206/455, 206/491; 493/243, 920

[56] References Cited

U.S. PATENT DOCUMENTS

| | | | |
|---|---|---|---|
| 601,922 | 4/1898 | Wieland | 229/72 |
| 901,357 | 10/1908 | Lewis | 206/449 |
| 1,269,247 | 6/1918 | Aslin | 150/132 |
| 1,316,615 | 9/1919 | Hocking | 206/449 |
| 1,404,193 | 1/1922 | Dietsche, Jr. | 229/72 |
| 1,515,901 | 11/1924 | Helmquest | 229/1.5 |
| 1,774,215 | 8/1930 | Weinthrop | 229/72 |
| 1,794,560 | 3/1931 | Styll | 229/1.5 R |
| 2,026,140 | 12/1935 | Poppe | 229/72 |
| 2,258,316 | 10/1941 | Buxton | 229/72 X |
| 2,378,020 | 6/1945 | Longworthy | 229/72 |
| 2,950,855 | 8/1960 | Zahner | 229/72 |
| 3,043,493 | 7/1962 | Clegg | 229/72 |
| 3,334,677 | 8/1967 | Toomey | 206/455 |
| 3,360,027 | 12/1967 | Price | 229/72 |
| 3,381,888 | 5/1968 | Schleutermann et al. | 229/72 |
| 3,537,728 | 11/1970 | Reese | 229/1.5 R X |
| 3,642,195 | 2/1972 | Tulisalo | 229/72 |
| 3,719,319 | 3/1973 | Schleutermann et al. | 229/72 |
| 3,758,136 | 9/1973 | Guyer | 229/1.5 |
| 3,779,786 | 12/1973 | Tone | 117/4 |
| 3,870,223 | 3/1975 | Wyant | 229/72 |
| 3,926,365 | 12/1975 | Sandstrom | 229/72 |
| 3,999,701 | 12/1976 | Ward | 150/132 |
| 4,047,661 | 9/1977 | Klein | 229/72 |
| 5,082,168 | 1/1992 | Gaetano | 229/72 |

*Primary Examiner*—Allan N. Shoap
*Assistant Examiner*—Jes F. Pascua
*Attorney, Agent, or Firm*—Stanley J. Price, Jr.

[57] ABSTRACT

A film negative and matching proof are held for storage in a receptacle formed from a unitary body of flexible material folded to form panels positioned in overlying relation to form a first pocket and a second pocket. One panel is common to both pockets and serves as a boundary layer between the pockets positioned in back-to-back relationship. One pocket is closed along opposite lateral sides and at one end portion with the opposite end portion remaining open to receive the negative protected against undesired contact. The second pocket is positioned to receive the proof along an open end portion and an open lateral side with the opposite end portion and lateral side being closed to facilitate ease of insertion and removal of the proof.

20 Claims, 4 Drawing Sheets

COMBINATION PHOTOGRAPHIC NEGATIVE AND PROOF HOLDER

CROSS-REFERENCE TO RELATED APPLICATION

This application is a continuation-in-part of U.S. application Ser. No. 578,737 filed Sep. 6, 1990 entitled, "Article Receiving Device For Holding Photographic Proofs And Negatives", now U.S. Pat. No. 5,082,168.

BACKGROUND OF THE INVENTION

1. Field of the Invention

This invention relates to a holding device for photographic negatives and proofs, and more particularly to a receptacle that facilitates the handling and processing of matching photographic negatives and proofs.

2. Description of the Prior Art

It is common practice in the photography industry to use glassine envelopes to receive and store photographic negatives. The glassine envelope being resistant to the passage of air and grease protects the negative from damage in the handling process. It is also well known to protect photographic film by mounting the film on aperture cards in which the body of the card contains an aperture through which the laminar material may be used. Negatives, slides, microfilm, and other transparencies are commonly mounted in aperture cards to permit their processing while avoiding contact with the transparency.

At one point in the film processing, a proof corresponding to the negative is printed and the proof is matched with the negative for analysis by the processing laboratory and/or the studio. During the examination of the proof, the negative must be preserved and maintained in association with the proof. Generally, the negative is maintained in a glassine receptacle, and the proof clipped to the receptacle so that the negative and the proof are not separated from one another. This is a cumbersome arrangement. While the negative is safely guarded in the glassine envelope, the proof is exposed to a risk of damage and at the very least from being separated from the negative which creates delays in the film processing.

It is also well known to utilize envelopes, folders, pocketbooks, wallets, cases and the like which include multiple pockets for the storage and display of laminar material. The laminar material while being protected from abuse in handling must be readily excessible for inspection, use and the like. A early version of a pocketbook containing multiple pockets for carrying documents and the like is disclosed in U.S. Pat. No. 601,922. Similar wallet related devices for the carrying of sheet material, such as documents, dollar bills, and record bearing laminar material are disclosed in U.S. Pat. Nos. 1,269,247; 1,404,193; 1,774,215; 2,026,140; 2,378,020; 3,334,677; 3,360,027; 3,758,136; and 3,999,701.

While many known holders for laminar material are suitable for sheet material such as documents, they are not satisfactory for the storage and handling of photographic negatives and proofs because the items must be visible for identification purposes, but at the same time protected from direct contact. Aperture cards, manufactured as disclosed in U.S. Pat. No. 3,779,786, serve the purpose of both mounting the transparency for efficient handling but also provide a full view of the content of the transparency. With an aperture card, the transparency is held in position overlying an aperture in the card. The transparency is attached to the card and becomes a part thereof. This does not facilitate the separation of the transparency from the aperture card. In many applications the transparency must be separated from its protected holding device being an envelope or an aperture card.

U.S. Pat. No. 4,047,661 discloses an envelope for containing photographic prints and negatives in separate pockets. The envelope is formed by front and back panels interconnected along three edges to form a first pocket for photographic prints. A center flap is connected to the back panel and overlies the back panel. A patch member is attached to the center panel and forms a second pocket for photographic negatives. The patch member is constructed of glassine type material so that the contents of the pocket are readily visible. The negative pocket is adhesively closed along one side edge and a lower edge; while the opposite side edge and upper edge remain open. With this arrangement, the negatives are protected against unwanted contact but are removable from the pocket.

U.S. Pat. No. 1,515,901 discloses another version of a mounting device for photographs in a cardboard container. The container includes flat portions which may be folded into and out of position to, in one mode, fold flat against the picture for the purpose of protecting the picture and, in another mode, turn backwardly and held in position exposing the picture for display.

U.S. Pat. No. 901,357 also discloses an envelope divided in sections and folded to receive for display picture postcards. In one arrangement, the envelope is unfolded to display a series of connected panels each connecting a postcard. When desired to safely store the postcards in mounted position, the envelope panels are folded in an accordian style so that the mounted postcards are positioned in overlying relation. End flaps are closed to seal the envelope or packet for addressing and mailing of the enclosed postcards.

U.S. Pat. No. 1,316,615 discloses a storage device in which a foldable strip of canvas material is creased transversely to form panels, each having diagonally extending slits at the corners to receive photographs. The photographs are mounted on the panels in side by side relation. When the strip is folded on the creases, the panels are superimposed and end flaps are folded over onto one another to securely protect the photographs.

While it has been suggested by the prior art devices to provide receptacles, holding devices and envelopes for protecting sheet material, particularly photographic transparencies, the known devices provide for the singular mounting of a transparency in the case of aperture cards and for multiple storage of negatives and corresponding photographic prints in separate pockets. This arrangement is suitable for the handling and distribution of developed prints. It is not efficient for the singular handling of a negative and matching proof. Therefore, there is need for a device to permit the efficient and secure handling of a negative and matching proof where the two items are maintained associated with one another, but are safely stored to prevent damage by unwanted contact.

SUMMARY OF THE INVENTION

In accordance with the present invention, there is provided a holding device for receiving inserts that includes an elongated body portion fabricated of a flexible, foldable material having upper and lower edges and a pair of side edges. A plurality of transverse score lines are positioned in spaced relation along the length of the body portion and extend between upper and lower edges. Transverse score lines divide the body portion into a plurality of panels separated from one another by the score lines. A first end panel is positioned at one of the side edges. A second end panel is positioned at the other of the side edges. An intermediate panel is positioned between the first and second end panels. A first fold is formed along the score line separating the first end panel from the intermediate panel to position the first end panel in overlying relation with the intermediate panel. A first pocket for receiving one insert is formed by the first end panel overlying the intermediate panel. A second fold is formed along the score line separating the second end panel from the intermediate panel to position the second end panel in overlying relation with the intermediate panel. A second pocket for receiving a second insert is formed by the second end panel overlying the intermediate panel. The first and second pockets are positioned in back-to-back relation to position the first and second inserts back-to-back and separated from one another by the intermediate panel. The first and second pockets each have opposite open end portions. The opposite open end portions of the first pocket are positioned in overlying with the opposite open end portions of the second pocket respectfully. A bottom flap is formed at the body portion lower edge to close one of the overlying open end portions of the first and second pockets with the opposite end portions of the first and second pockets remaining open for insertion and removal of the inserts relative to the first and second pockets.

Further in accordance with the present invention, there is provided a receptacle for a photographic negative and matching proof that includes a unitary body portion of flexible material folded to form a plurality of panels positioned in overlying relation to one another to form a first pocket and a second pocket. The first and second pockets are positioned back-to-back, with one of the panels being common to both of the pockets to separate the pockets one from another. The first and second pockets have overlying closed end portions and overlying open end portions. The first pocket has oppositely positioned closed sides, a closed end portion and an opposite open end portion to receive the negative. The second pocket has a closed side and an opposite open side with a closed end portion and an opposite open end portion to receive a proof corresponding to the negative such that the negative and the proof are positioned back-to-back and separated from one another in said first and second pockets respectively.

The present invention is also directed to a method for handling and storing inserts in a receiving device that includes the steps of forming an insert receiving device by folding a unitary body of flexible material to form a plurality of panels. The panels are positioned in overlying relation to one another to form a first panel, an intermediate panel, and a second panel. The first and second panels are separated from one another by the intermediate panel. A bottom edge of the material including a portion of the first, second and intermediate panels positioned in overlying relation is folded to form a bottom flap generally parallel to the bottom edge of the material. The folded bottom flap is secured to the material to form a first pocket and a second pocket positioned back-to-back with the first and second pockets each having a closed end portion and an opposite open end portion. The first and second pockets are separated from one another by the intermediate panel.

Accordingly, a principal object of the present invention is to provide method and apparatus for receiving and handling in back-to-back relation a photographic negative and matching proof, where the proof and negative are easily accessible but protected from unwanted contact.

Another object of the present invention is to provide a holder for transparencies, particularly a negative and matching proof, where the negative is inserted in a pocket through one open end portion of the pocket, while, the proof is received in a second pocket behind the first pocket which is open along one side and one end portion to facilitate ease in the insertion and removal of the proof.

An additional object of the present invention is to provide a glassine holder for transparencies in which pockets are positioned back-to-back, where one pocket is substantially secure with only one opening and the opposite pocket is more readily accessible by having two openings.

These and other objects of the present invention will be more completely disclosed and described in the following specification, the accompanying drawings and the appended claims.

DESCRIPTION OF THE PREFERRED EMBODIMENTS

Figure 1:
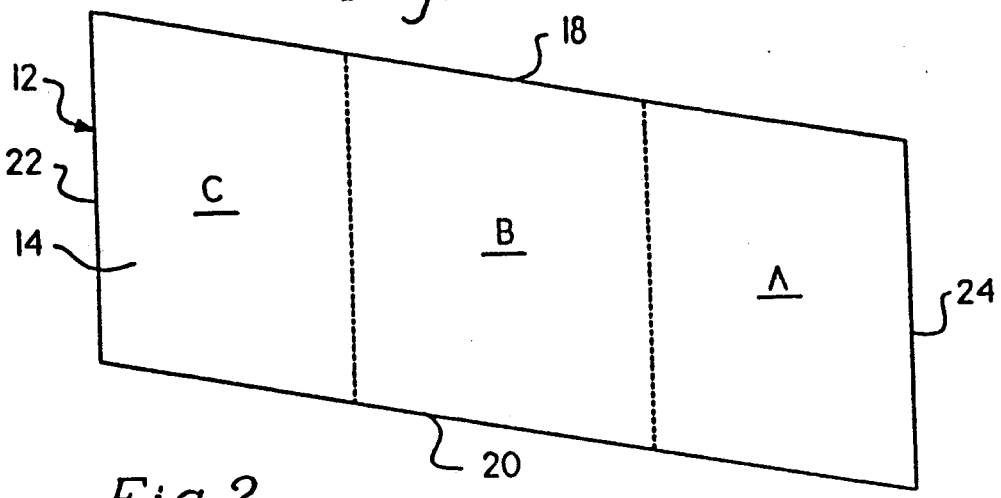
FIG. 1 is a top plan view of a sheet of material with the fold lines formed by score lines.
Figure 2:
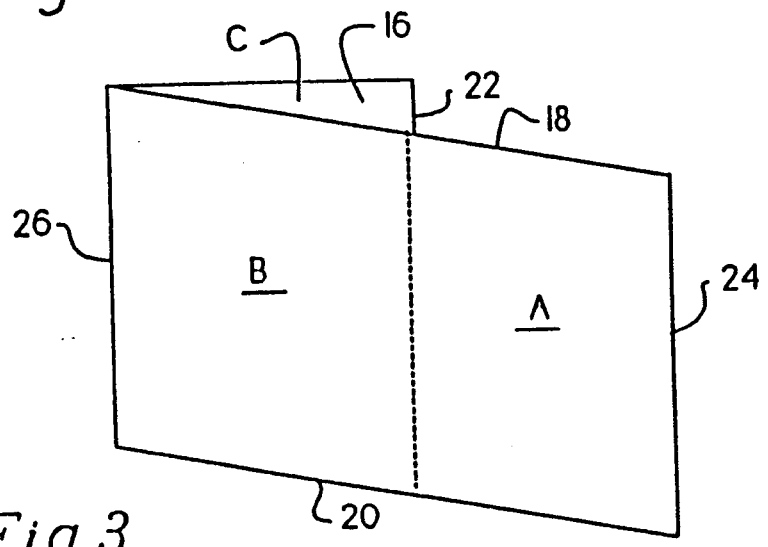
FIG. 2 is a top plan view of the sheet of material, illustrating a first fold along one of the score lines.
Figure 3:
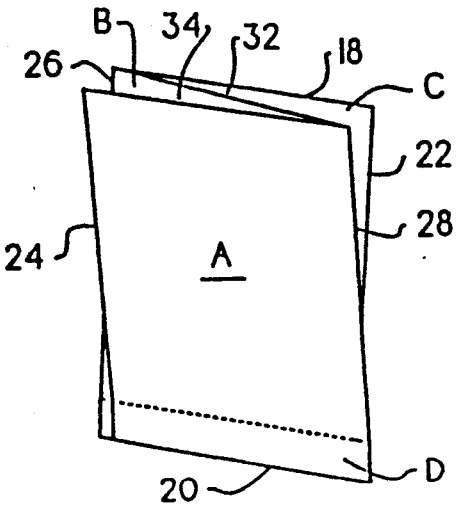
FIG. 3 is a top plan view of the folded sheet material, illustrating the score line for forming the bottom closure flap.
Figure 4:
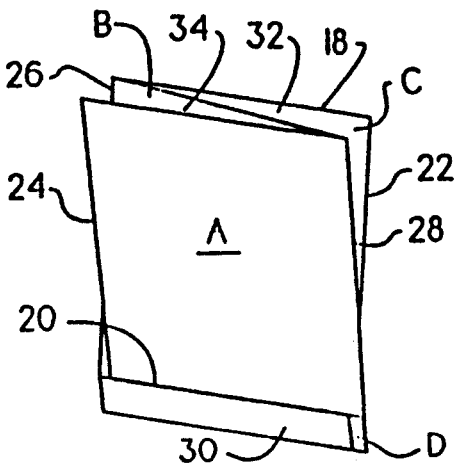
FIG. 4 is a top plan view of the sheet of material folded to form an article receiving device in accordance with the present invention.
Figure 5:
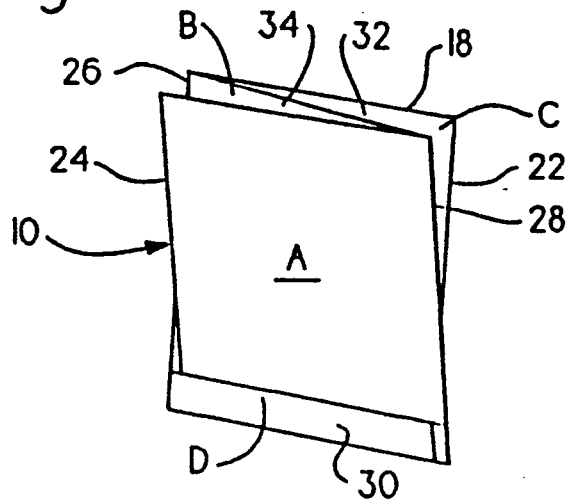
FIG. 5 is a side elevational view of the article receiving device.
Figure 6:
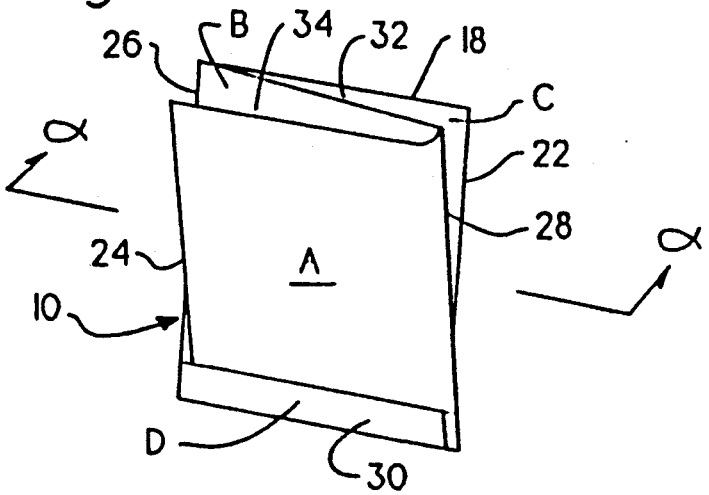
FIG. 6 is another side elevational view of the article receiving device.

Referring to the drawings, and particularly to FIGS. 1–7, there is illustrated a first embodiment of an article receiving device generally designated by the numeral 10 for use in receiving and separating photographic negatives and photographic proofs. As shown in FIGS. 5 and 6, article receiving device 10 consists of a panel A joined by fold 28 to panel B. Panel B is joined to panel C by fold 26. A bottom flap D which is composed of a portion of panel A, panel B, and panel C, is attached to panel A, panel B, and panel C by fold 30. Bottom flap D is glued to panel A with any suitable glue. With this arrangement a first pocket 32 and a second pocket 34 are formed for the article receiving device 10.

Figure 7:
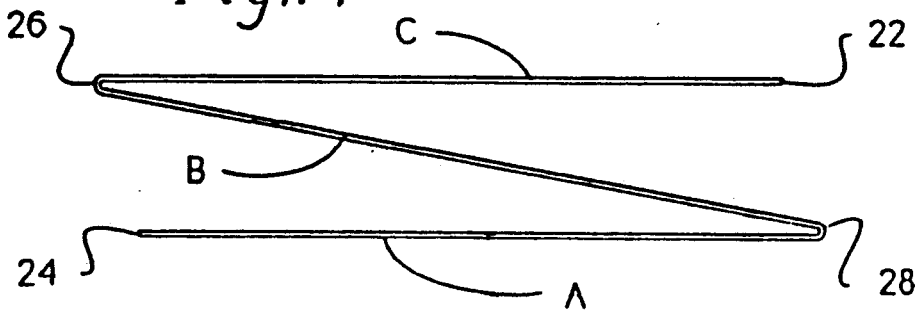
FIG. 7 is a cross sectional view of the article receiving device taken along line alpha-alpha of FIG. 6.
Figure 8:
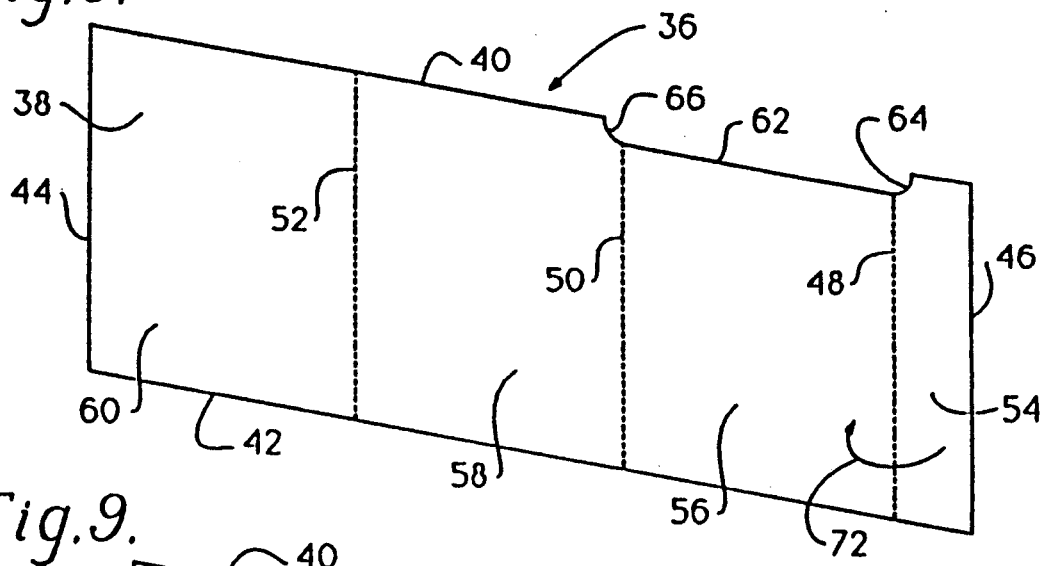
FIG. 8 is a plan view of sheet material divided into panels by score lines for forming another embodiment of the article receiving device of the present invention.

Fold 28, fold 30, panel A, and panel B form the second pocket 34 which is best illustrated in FIGS. 5, 6 and 7. As can be seen in FIGS. 5 and 6, second pocket 34 opens at top edge 18 which is opposite the third fold 30. Second pocket 34 also opens on second side edge 24 which is opposite the second fold 28.

First pocket 32 is formed between panel C and panel B and is defined by the first fold 26 and the third fold 30. First pocket 32 opens at the top edge 18 which is opposite from the third fold 30. First pocket 32 also opens on the first side edge 22 which is opposite the first fold 26.

Thus it can be seen from FIGS. 5, 6, and 7 that article receiving device 10 has two pockets. The first pocket 32 is formed between panel C and panel B and is bounded by first fold 26 and third fold 30. Second pocket 34 is formed between panel A and panel B and is bounded by second fold 28 and third fold 30. First pocket 32 opens on first side edge 22, and second pocket 34 opens on second side edge 24. Both first pocket 32 and second pocket 34 open at top edge 18.

The present invention also includes the process of making the article receiving device 10. Article receiving device 10 is made from a sheet of material 12 having a front face 14, a rear face 16, a top edge 18, a bottom edge 20, a first side edge 22, and a second side edge 24 as shown in FIGS. 1, 2, 3 and 4. The sheet of material 12 is preferably glassine paper. Panel C is formed by folding approximately one-third of the sheet of material 12 toward the rearward face 16 of the sheet of material 12. Thus fold 26 is formed, which is parallel to the first side edge 22. A second panel A is formed by folding another approximate one-third of the sheet of material 12 toward the front face 14 of the sheet of material 12. The fold 28 formed by folding panel A onto the front face 16 of the material 12 is parallel to fold 26.

A third fold 30 is formed by folding over a portion of the bottom edge 20 of panel A, panel B, and panel C transversely to the longitudinal axis of fold 26 and fold 28.

Thus, an article receiving device 10 is formed having two pockets. The first pocket 32 is formed between panel C and panel B. First pocket 32 is bounded by the first fold 26, and the bottom fold 30. First pocket 32 opens at the top edge 18 and at the first side edge 22.

A second pocket 34 is formed between panel A and panel B. Second pocket 34 is bounded by the second fold 28 and the third fold 30. Second pocket 34 opens at top edge 18 and second side edge 24.

Referring to FIGS. 8–13, there is illustrated a second embodiment of the present invention for forming an article receiving device by which photographic negatives and proofs are efficiently handled and preserved from damage. The combination photographic proof and negative holder shown in FIGS. 8–13 is formed from a planar sheet of material generally designated by the numeral 36. The planar sheet 36 includes an elongated body portion 38 fabricated of a foldable, flexible material such as glassine. The glassine is well known for its properties of being resistant to the passage of air and for protecting negatives and proofs from foreign substances being absorbed through the sheet material.

The body portion 38 has a length substantially greater than its width thereby forming elongated upper edge 40 and elongated lower edge 42. Extending between the upper and the lower edges 40 and 42 are side edges 44 and 46. Positioned within the body portion 38 between the side edges 44 and 46 are a plurality of transverse score lines 48, 50 and 52. The score lines 48, 50 and 52 are substantially spaced equidistant apart and extend from edge 40 to edge 42. Accordingly, the score lines 48, 50 and 52 divide the sheet material body portion 38 into a plurality of panels 56, 58 and 60. The panels 56 and 58 are substantially equal in width. Panel 60 is slightly less in width than panels 56 and 58, as will be explained later in greater detail. Panel 56 includes a panel end portion 54 which is relatively narrow in comparison with panels 56, 58 and 60. The panel end portion 54 extends from the panel 56 and thereby forms the side edge 46 of the body portion 38. Preferably, panel 56 is provided with an upper edge 62 that is recessed below upper edge 40 which is common to panels 58 and 60. The panel upper edge 62 merges into the upper edge 40 along the arcuate edge portions 64 and 66.

Figure 9:
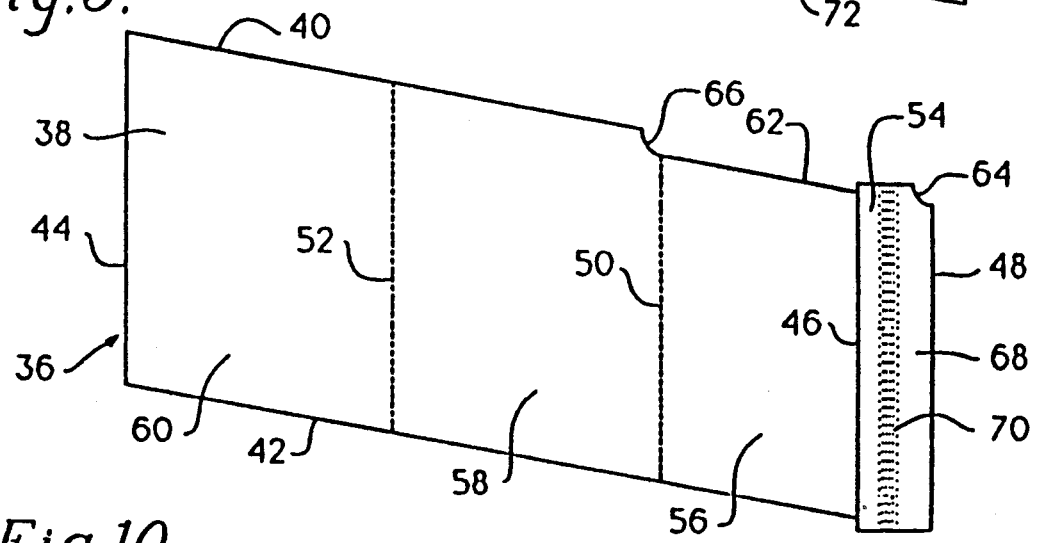
FIG. 9 is a plan view of the article receiving device shown in FIG. 8, illustrating an end panel having an adhesive strip.
Figure 10:
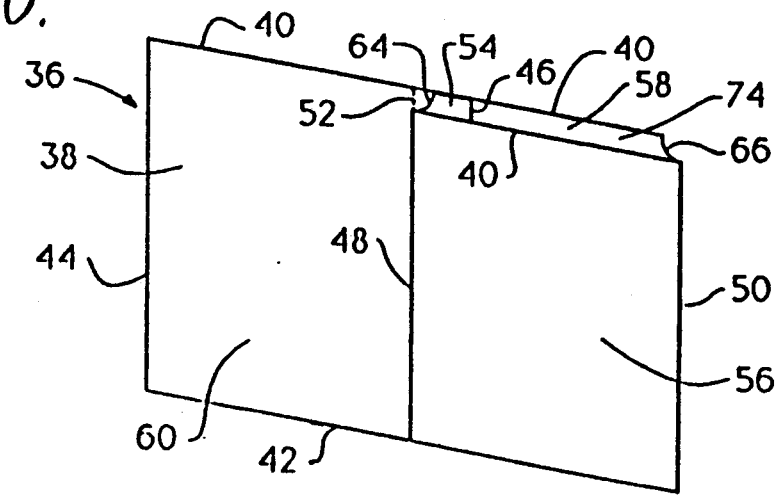
FIG. 10 is a plan view of the sheet material folded to form a first pocket by contact of the adhesive material on the end flap with one of the intermediate panels.

As illustrated in FIG. 10, the panel end portion 54 is provided on a side 68 with a strip of adhesive material 70. The adhesive strip 70 is preferably centered on the side 68 of panel end portion 54. The adhesive strip 70 is not visible in FIG. 8, but when the panel end portion 54 is folded along score line 48 and turned in the direction of arrow 72, the panel surface 68 with the adhesive strip 70 is visible as seen in FIG. 9.

After the panel end portion 54 is folded along score line 48 in the direction of the arrow 72, the panel 56 is folded along the score line 50 and the panel 56 folded in the direction of panel end portion 54. With this arrangement, the score line 48 substantially overlies the score line 52, separating panels 58 and 60. The panel end portion 54 is positioned in contact with the panel 58 where the adhesive strip 70 on the side 68 of panel end portion 54 is in contact with the surface of panel 58 to thereby secure the panel end portion 54 to the intermediate panel 58 and form a first pocket generally designated by the numeral 74.

The pocket 74 is closed along one side formed at the score line 50 and at an opposite side along the score line 48 that separates the panel end portion 54 from the second panel 56. In view of the adhesive engagement of the panel end portion 54 to the panel 58 at a point displaced from the score line 52, the edge of the first pocket 74 along score line 48 is movable relative to the score line 52 because the adhesive connection is spaced from the score line 52. This permits movement of the side of the first pocket along score line 48 in the vicinity of the arcuate portion 64 and proceeding down the width of glassine body portion 38 so that the first pocket 74 is expandable to a limited extent. In addition, the first pocket 74 includes opposite open end portions formed at the upper edge 40 of the body portion 38 and at the lower edge 42 of the body portion 38.

Figure 11:
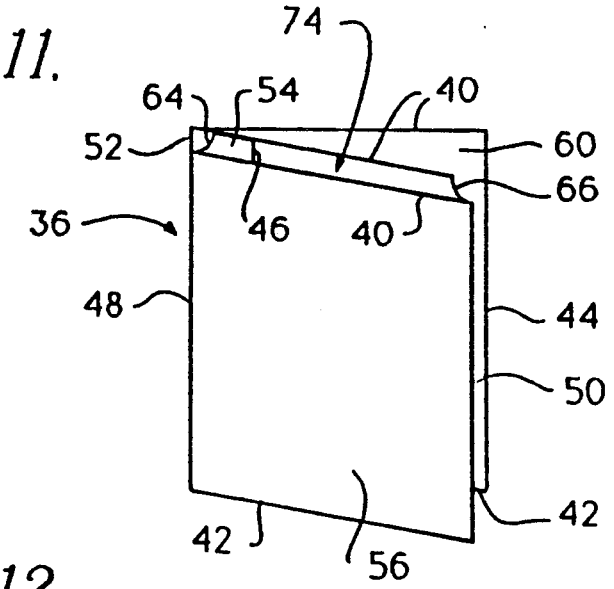
FIG. 11 is a plan view of the sheet material folded to form a second pocket oppositely of the first pocket.

Now referring to FIG. 11, there is illustrated the planar sheet material 36 further folded along score line 52 to position end panel 60 in underlying relation with the adjacent intermediate panel 58. The end panel 60 is folded along score line 52 to position the edge 44 in substantially overlying relation with the edge of the first pocket 74 formed at the score line 50. When folded over and positioned oppositely of the intermediate panel 58, the end panel 60 forms a second pocket generally designated by the numeral 76 in FIG. 12.

The second pocket 76 includes side edges bound by the score line 52 at one side and the edge 44 of the end panel 60 at the other side. The opposite ends of pocket 76 are initially open at the upper edge 40 and lower edge 42. It is important to note, however, that the edge of the pocket 76 along score line 52 is closed, i.e. access to the pocket 76 can not be obtained along the closed side corresponding to score line 52. However, the opposite side of the second pocket 76 at the edge 44 is open to thereby permit access to the pocket 76 at any point along the length of the side edge 44. In contrast, the first pocket 74 is closed at the edges corresponding to score lines 48 and 50 and only open along the top edge 40.

Figure 12:
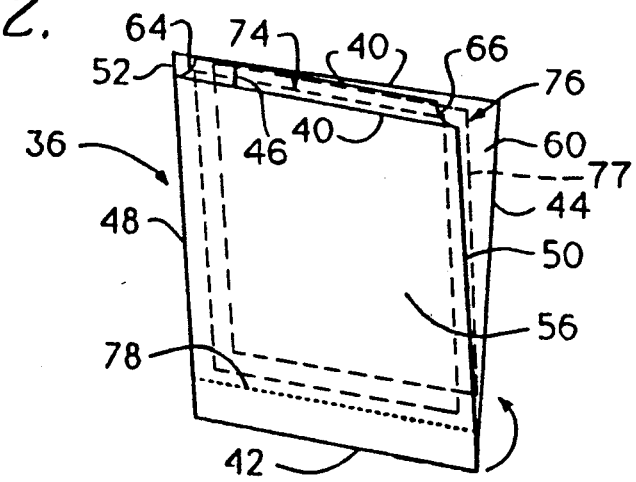
FIG. 12 is plan view of the sheet material, illustrating a score line for folding the material at one end portion to close one of the open ends of each pocket.
Figure 13:
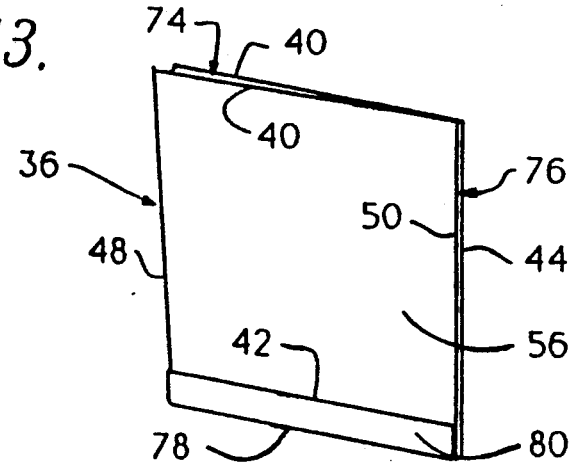
FIG. 13 is a plan view illustrating the formed article receiving device, illustrating one pocket open at only one end portion and an opposite pocket being accessible along one side edge and an open end portion.

Now referring to FIG. 13, there is illustrated the final step in the formation of the article receiving device of the present invention in which the bottom open end portion of the first pocket 74 and the second pocket 76 adjacent the lower edge 42 of the glassine body portion 38 is closed. Closure of the lower open end portion of each pocket 74 and 76 is accomplished by folding the body portion 38 with the panels 56, 58 and 60 positioned in overlying relation along a line spaced from lower edge 42. For example, as seen in FIG. 12, a fold line 78 is formed transversely across the width of the overlying panels and spaced a preselected distance from the lower edge 42 of body portion 38. The fold line 78 may be located at any point spaced from the edge 42, as determined by the desired depth of the pockets 74 and 76. The overlying panels 56–60 are folded along line 78 to form a bottom or closure flap 80 for the pockets 74 and 76. Suitable means are used to adhere the bottom flap 80 in overlying relation with the panel 56 of the glassine body portion 38, as shown in FIG. 13, to close the lower open end portions of each of the pockets 74 and 76.

Once the lower open end portion of each pocket 74 and 76 is closed by the folding and sealing of the closure flap 80. The assembling of the holding device for receiving a negative and matching proof is completed. The holding device is preferably utilized to hold a single negative 75, as indicated in phantom in FIG. 12, in the pocket 74 which is accessible only at its open end portion at the upper edges 40. The sides of the first pocket 74 formed along the score lines 48 and 50 are closed, as well as, the lower end of the pocket 74 formed by the folded closure flap 80. With this arrangement, the negative 75 is securely held within the pocket 74. The negative 75 is confined on three sides of the pocket 74.

The pocket 76 is open at the upper end portion along the edge 40 and is also open at one side of the pocket 74 along the side edge 44 as seen in FIG. 12. The opposite side edge of the pocket 76 formed along score line 52 is closed and the bottom of the pocket 76 closed by the folded bottom flap 80.

With the second pocket 76 open along one end portion and one side portion access to the interior the pocket 76 is more readily obtained then with the pocket 74 which is open only at one end portion. The open end portions of the pockets 74 and 76 overlie one another. In this respect, the pocket 76 is particularly adapted to receive a proof 77, shown in phantom in FIG. 12, corresponding to the negative 75. The proof 77 is handled to a greater extent than the negative 75 for examination purposes and therefore, it is convenient to be able to insert and remove the proof 77 from the pocket 76 that is open along two edges. The concern for protecting the proof 77 from unnecessary contact is not as great as it is with the negative 75.

With the receptacle formed by the present invention, the negative 75 and corresponding proof 77 are positioned in back-to-back relationship, but are removed from contacting each other by a boundary layer. The boundary layer is formed by the intermediate panel 58. As a boundary, the panel 58 is common to both pockets 74 and 76 and divides the pockets from each other. The end panel 60 overlies the intermediate or boundary panel 58 to form the next pocket 76 which is accessible along the open end portion and one side of the pocket. To facilitate ease of access to the second pocket 76 along the side edge 44 the width of the end panel 60, in one embodiment, is less than the width of the underlying panel 58. In this respect, panel 58 extends outwardly from the edge 44 of end panel 60. This exposes or separates the edge 44 from the underlying edge of panel 58 formed along score line 50. Consequently, the edge 44 is easily displaced to open the pocket 76 to receive an insert, such as a proof.

Thus, the article receiving device of the present invention provides an efficient means for storing a photographic negative and matching proof where the proof is readily accessible and the negative is securely positioned from unwanted displacement and contact which would otherwise be damaging to the negative and not necessarily damaging to the proof.

Accordingly to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A holding device for receiving inserts comprising, an elongated body portion fabricated of a flexible, foldable material having upper and lower edges and a pair side edges, a plurality of transverse score lines positioned in spaced relation along the length of said body portion and extending between said upper and lower edges, said transverse score lines dividing said body portion into a plurality of panels separated from one another by a set of score lines, a first end panel at one of said side edges, a second end panel at the other of said side edges, an intermediate panel positioned between said first and second end panels, a first fold formed along a score line separating said first end panel from said intermediate panel to position said first end panel in overlying relation with said intermediate panel, a first pocket for receiving one insert formed by said first end panel overlying said intermediate panel, a second fold formed along a score line separating said second end panel from said intermediate panel to position said second end panel in overlying relation with said intermediate panel, a second pocket for receiving a second insert formed by said second end panel overlying said intermediate panel, said first and second pockets being positioned in back-to-back relation to position said first and second inserts back-to-back and separated from one another by said intermediate panel, said first and second pockets each having opposite open end portions, said opposite open end portions of said first pocket being positioned in overlying relation with said opposite said open end portions of said second pocket respectively, and a bottom flap formed at said body portion lower edge to close one of said overlying open end portions of said first and second pockets with the opposite end portions of said first and second pockets remaining open for insertion and removal of the inserts relative to said first and second pockets.

2. A holding device as set forth in claim 1 in which, said first pocket includes a pair of sides formed at one side by said first fold and at the other side by one of said side edges, adhesive means for securing said first end panel to said first intermediate panel along one of said side edges to close said first pocket at said sides, and said one end portion of said first pocket being closed with said opposite end portion being open for the insertion and removal of inserts into and out of said first pocket.

3. A holding device as set forth in claim 2 in which, said adhesive means includes a strip of adhesive extending along said side edge of said first end panel.

4. A holding device as set forth in claim 3 in which, said first end panel includes an extension panel at said one of said side edges, a fold line separating said first end panel from said extension panel to position said extension panel in overlying relation with said intermediate panel, said adhesive strip engaging said intermediate panel and said extension panel displaced from said fold line between said first end panel and said intermediate panel to form a closed side edge of said first pocket, and said closed side edge of said first pocket being movable relative to said intermediate panel to allow for expansion of said first pocket.

5. A holding device as set forth in claim 1 in which, said intermediate panel forms a layer common to both said first pocket and said second pocket.

6. A holding device as set forth in claim 1 in which, said intermediate panel forms a boundary layer between said first pocket and said second pocket.

7. A holding device as set forth in claim 1 in which, said intermediate panel has a width greater than the width of said second end panel so that said side edge at said second end panel is spaced from said first fold forming an edge of said intermediate panel to provide access to an opening at said side thereof into said second pocket.

8. A holding device as set forth in claim 1 in which, said second pocket has an opening extending across one end portion thereof and is closed at the opposite end portion thereof, said second pocket being bounded at side edges thereof by said second fold to close said second pocket at one side thereof and a free edge overlying said first fold between said first end panel and said intermediate panel to form an opening into said second pocket, and said opening into said second pocket extending across one end portion of said second pocket and downwardly along one side edge of said second pocket.

9. A holding device as set forth in claim 1 which includes, said bottom flap formed by a fold of said first end panel, said second end panel, and said intermediate panel in overlying relation adjacent one of said overlying end portion of said first and second pockets, and adhesive means positioned between said bottom flap and said first end panel adjacent to said fold to close said first and second first at one end portions thereof with the opposite end portions of said first and second pockets remaining open.

10. A holding device as set forth in claim 1 in which, said upper edge of said material forms a top edge of said first end panel, a top edge of said intermediate panel, and a top edge of said second end panel, said top edge of said first end panel being generally parallel to and spaced from said top edge of said intermediate panel and said top edge of said second end panel, and said top edges of said first end panel, said intermediate panel, and said second end panel forming the open end portions of said first and second pockets.

11. A receptacle for a photographic negative and matching proof comprising, a unitary body portion of a flexible material folded to form a plurality of panels positioned in overlying relation to one another to form a first pocket and a second pocket, said first and second pockets being positioned back-to-back with one of said panels being common to both of said pockets to separate said pockets from one another, said first and second pockets having overlying closed end portions and overlying open end portions, said first pocket having oppositely positioned closed sides, a closed end portion, and a opposite open end portion to receive a negative, and said second pocket having a closed side and an opposite open side with a closed end portion and an opposite open end portion to receive a proof matching with the negative such that the negative and proof are positioned in back-to-back relationship and separated from one another in said first and said second pockets respectively.

12. A receptacle as set forth in claim 11 in which, one of said panels being common to both of said pockets forms a boundary layer separating said first pocket from said second pocket.

13. A receptacle as set forth in claim 12 in which, said first pocket is connected to said second pocket by said panel common to both of said pockets.

14. A receptacle as set forth in claim 11 in which, one of said closed sides of said first pocket includes means for expanding said first pocket.

15. A method for handling and storing inserts in a receiving device comprising the step of, forming an insert receiving device by folding a unitary body of flexible material to form a plurality of panels, positioning the panels in overlying relation to one another to form a first panel, an intermediate panel, and a second panel, separating the first and second panels from one another by the intermediate panel, folding a bottom edge of the material including a portion of the first, second and intermediate panels positioned in overlying relation to form a bottom flap generally parallel to the bottom edge of the material, securing the folded bottom flap to the material to form a first pocket and a second pocket positioned back-to-back with the first and second pockets each having a closed end portion and an opposite open end portion, and separating said first and second pockets from one another by the intermediate panel.

16. A method as set forth in claim 15 which includes, closing the first pocket at opposite sides thereof and at one end portion with an opposite second end portion remaining open to provide access to the first pocket, closing the second pocket along one side and at one end portion oppositely of the closed end portion of the first pocket, and opening the second pocket along a second side and at a second end portion oppositely of the open end portion of the first pocket.

17. A method as set forth in claim 16 which includes, inserting a first insert through the open end portion of the first pocket to surround and protect the first insert from contact in the first pocket, inserting a second insert through the open second side and open end portion of the second pocket, and separating the first and second inserts from one another in back-to-back relation in the insert receiving device.

18. A method as set forth in claim 15 which includes, expanding the first pocket relative to the second pocket to facilitate inserting the first insert through the open end portion in the first pocket.

19. A method as set forth in claim 15 which includes, forming the open end portion of the first pocket by a top edge of the first panel positioned generally parallel and recessed below a top edge of the intermediate panel.

20. A method as set forth in claim 15 which includes, connecting the second pocket to the first pocket by the intermediate panel.

* * * * *